US006368174B1

(12) United States Patent
Magee

(10) Patent No.: US 6,368,174 B1
(45) Date of Patent: Apr. 9, 2002

(54) VISIBLE FLOATATION DEVICE

(76) Inventor: Terence Magee, 1658 McCarren Way, Santa Rosa, CA (US) 95401

( * ) Notice: Subject to any disclaimer, the term of this patent is extended or adjusted under 35 U.S.C. 154(b) by 0 days.

(21) Appl. No.: 09/595,000

(22) Filed: Jun. 15, 2000

(51) Int. Cl.[7] ..... B63C 9/08
(52) U.S. Cl. ..... 441/89; 441/106
(58) Field of Search ..... 441/80, 89, 106

(56) References Cited

U.S. PATENT DOCUMENTS

| | | | | | |
|---|---|---|---|---|---|
| 827,350 | A | * | 7/1906 | Crofford | 441/89 |
| 3,095,568 | A | * | 6/1963 | Aine et al. | 441/89 |
| 3,798,692 | A | * | 3/1974 | Madeley | 441/89 |
| 5,326,297 | A | * | 7/1994 | Loughlin | 441/89 |
| 5,736,954 | A | * | 4/1998 | Veazey | 441/89 |

FOREIGN PATENT DOCUMENTS

| | | | | |
|---|---|---|---|---|
| DE | 3625812 | * | 2/1988 | 441/89 |
| SU | 472862 | * | 6/1975 | 441/89 |

* cited by examiner

*Primary Examiner*—Stephen Avila
(74) *Attorney, Agent, or Firm*—Risto A. Rinne, Jr.

(57) ABSTRACT

An apparatus for the detection of a person afloat in the water includes a garment portion that is worn by the person. The garment portion preferably includes an inflatable vest. An actuation mechanism detects immersion in the water, preferably at a predetermined depth, and then automatically inflates the vest by puncturing or opening a first container and releasing a gas therein. A balloon is also attached to the vest and is also inflated by the gas of the first container providing the gas in the first container is a lighter-than-air type of a gas that is able to cause the balloon to rise in the air. A tether secures the balloon to the vest. If the gas in the first container is not suitable for filling the balloon, a second container is used that contains the desired lighter-than-air gas and it is also either punctured or otherwise opened by the actuation mechanism so as to inflate the balloon. The balloon automatically releases apart from the vest upon inflation and rises the length of the tether above the person. Devices to manually inflate the vest and the balloon are also described.

16 Claims, 1 Drawing Sheet

VISIBLE FLOATATION DEVICE

BACKGROUND OF THE INVENTION

1. Field of the Invention

The present invention, in general relates to safety and rescue equipment and, more particularly, to floatation devices that also help to spot a person afloat in the water.

Ships and boats sometimes sink or capsize. This can happen anywhere, including at sea, in a lake, or in a harbor. Anywhere there is water there is this risk. People may also fall overboard for any number of reasons and under a wide variety of circumstances. In all such events, people end up in the water. Sometimes, they are conscious when they contact the water and sometimes they are unconscious.

There are two issues that always arise when such an event occurs. The first issue involves attempts at keeping the person alive in the water. Generally, for this to occur their must be floatation assistance of some sort. To this end, all manner of life-jackets, life-vests, ski-belts, and other types of floatation assistance devices have been designed.

The second issue has not had the attention it deserves and that is one of rescue. The person needs to be rescued as soon as possible.

If the water is cold, for example, a speedy rescue can be equally as important as is keeping them afloat.

Hypothermia will soon lower their body temperature and they will die if they are not promptly removed from the cold water. Keeping them afloat may only extend their survival time by a matter of minutes if the water is very cold.

There are other perils that face a person adrift at sea. Sharks pose a very real threat to survival, especially if there is any bleeding occurring or if there is thrashing about in the water.

Often when people fall overboard it is very difficult to spot them in the water. The chop of the waves obscures their presence. They are only visible for a moment at a time, if even that, and only so when all of the waves intermediate the person and boat or ship are at a low point.

Since most water based rescue is attempted by boat this problem is especially acute. The proximity of those in the rescue boat to the water provides a poor (i.e., a low) angle of visibility. This is often well below the "critical angle" for light absorption in water. This means that when one is looking at the water surface at a low angle the water tends to reflect most of the incident light. This produces glare and makes it all the more difficult to spot someone afloat in the water.

If aerial rescue is attempted, such as when a ship sinks, the survivors will be difficult to spot from high and afar and may, in fact, be almost impossible to spot.

Another issue is that when people are on a boat or a ship, they are often sensitive about wearing a life-vest or life-jacket while they are on the boat or ship. They may feel self-conscious. A preferred type of a life-jacket would be highly visible. Therefore, it would be brightly colored and probably bulky. While these attributes would be of benefit to being spotted in the water they make the wearer especially conspicuous while he or she is on board. Consequently, there will be resistance to wearing such a device while on board. If a sudden event, such as falling overboard occurs, it is then too late.

Obviously then, a person would want as visible as possible a life-jacket if they suddenly found themselves in the water, but until that happens they do not want to wear a conspicuous floatation device. This produces a conflict in purpose. A floatation device that is conspicuous in the water and inconspicuous while on board is optimum.

Another problem arises if the person is unconscious when they contact the water. Then they will need automatic floatation assistance as well as assistance to aid in spotting them. They will not be able to accomplish either critical need if they, themselves, are unconscious.

Accordingly, there exists today a need for a floatation device that increases the chances of being seen by rescue personnel. It would be especially useful if such a device were automatic in its operation and unobtrusive during normal wear.

Clearly, such an apparatus would be a useful and desirable device.

2. Description of Prior Art

Floatation and detection devices are, in general, known. For example, the following patents describe various type of these devices:

U.S. Pat. No. 3,130,424 to Santangelo, Apr. 28, 1964;

U.S. Pat. No. 3,173,162 to Elder, Jr., Mar. 16, 1965;

U.S. Pat. No. 3,490,649 to Sheridan, Jan. 20, 1970;

U.S. Pat. No. 3,716,882 to Feb. 20, 1973;

U.S. Pat. No. 3,798,692 to Madeley, Mar. 26, 1974;

U.S. Pat. No. 3,877,096 to Apr. 15, 1975;

U.S. Pat. No. 3,881,531 to May 6, 1975;

U.S. Pat. No. 4,114,561 to Asaro, Sep. 19, 1978;

U.S. Pat. No. 4,498,881 to Buckle, Feb. 12, 1985;

U.S. Pat. No. 4,815,677 to Rushing et al., Mar. 28, 1989;

U.S. Pat. No. 4,968,277 to Parish et al., Nov. 6, 1990;

U.S. Pat. No. 5,027,977 to Kay et al., Jul. 2, 1991;

U.S. Pat. No. 5,095,845 to Murphy, Mar. 17, 1992;

U.S. Pat. No. 5,199,374 to Blanchette, Apr. 6, 1993; and

U.S. Pat. No. 5,518,430 to Crowder et al., May 21, 1996.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices. Furthermore, the above described devices are useful to an understanding of the present invention and are each, therefore, incorporated as a reference into this specification.

OBJECTS AND SUMMARY OF THE INVENTION

It is an object of the present invention to provide a visible floatation device that includes a vest.

It is also an important object of the invention to provide a visible floatation device that includes a vest that automatically inflates.

Another object of the invention is to provide a visible floatation device that is highly visible.

Still another object of the invention is to provide a visible floatation device that includes a lighter than air balloon.

Still yet another object of the invention is to provide a visible floatation device that includes a highly visible lighter than air balloon.

Yet another important object of the invention is to provide a visible floatation device that includes a lighter than air balloon that is highly visible to radar.

Still yet another important object of the invention is to provide a visible floatation device that is relatively inconspicuous when not in use.

Briefly, a visible floatation apparatus that is constructed in accordance with the principles of the present invention has a garment portion that is worn by a user. Preferably the garment portion includes an inflatable vest that inflates, either manually or automatically upon contact with the water and a lighter than air balloon that is also inflated and deployed. Inflation of the balloon is either manually actuated or automatically actuated, as desired. According to a preferred embodiment, the balloon includes a highly radar reflective inner lining or coating material as well as a highly visible external lining or coating that is disposed over the inner lining.

DETAILED DESCRIPTION OF THE INVENTION

Figure 1:
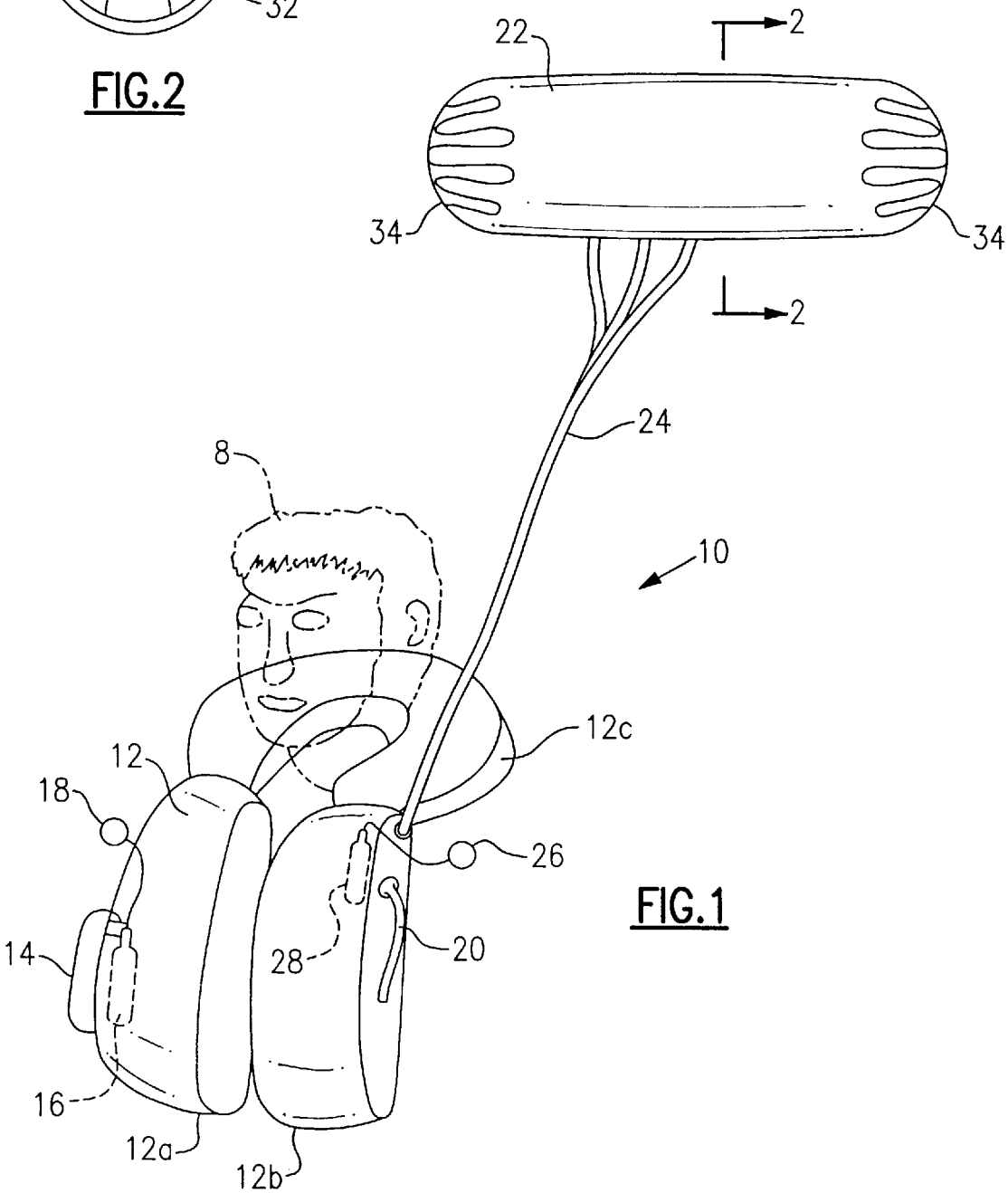
FIG. 1 a view in perspective of a visible floatation device.

Referring to FIG. 1 is shown, a visible floatation device, identified in general by the reference numeral 10.

The visible floatation device 10 includes a garment portion that is worn by a user 8. The garment portion preferably is an inflatable vest 12. The vest 12 is constructed of any material well known in the arts and of any color as desired. Obviously, highly visible colors, like bright orange other bright colors are usually preferable.

An exception to this is when the vest 12 is worn and it is desirable that it be somewhat more inconspicuous. Then, a less vibrant appearance may be preferred, but one that still fosters detection when in the water. Although the preferred embodiment of the vest 12 is described, clearly other less obtrusive garment designs are well within the scope of those having ordinary skill in these arts after first having benefited from the instant invention.

The vest 12 includes an automatic actuation mechanism 14. The actuation mechanism 14 is a triggering mechanism that automatically inflates the vest 12 when certain conditions occur.

The use of such kinds of triggering devices are well known and certain of the aforementioned prior art patents address these types of devices.

Basically, there are two conditions upon which the actuation mechanism 14 will inflate the vest 12. The first is if contact occurs with the water, such as when a person is thrown overboard. A second condition is when a particular water pressure is experienced, such as when a person is disposed a particular depth under the water, for example six feet deep.

The latter is a more sophisticated type of a triggering device that detects not only when a person is in the water but if they are beginning to sink. If the pressure increases sufficiently, the actuation mechanism 14 detects that increase in pressure, inflates the vest 12 and raises the person to the surface.

One possible embodiment for construction of the vest 12 includes a first compartment 12*a* and a second compartment 12*b* and a collar compartment 12*c*. Each of these compartments 12*a*–12*c* are intended to float and to orient a person with their face out of the water in a "heads-up" position. It is well known in the floatation life vest arts that this position provides optimum safety especially for an unconscious person.

Obviously, any number of other compartments (not shown) may be used with the vest 12. Clearly, other configurations for the design and appearance of the vest 12 may be also accomplished. Furthermore, each of the compartments 12*a*–*c* may incorporate any feature known or developed to aid in the inflation of the vest 12.

For example, methods are known to prevent over-inflation of the compartments 12*a*–*c* as well as to isolate each compartment, one apart from the other, so that if one were to develop a leak it would not affect any of the other compartments. The use of pressure relief valves are known devices to prevent over-inflation and the use of one-way valves (not shown) are well known methods for isolating the compartments.

The actuation mechanism 14, when triggered, releases compressed gas from a first container 16. The first container may contain any type of a gas that is preferred, such as carbon dioxide, compressed air, or a lighter-than-air gas to inflate the vest 12. A battery (not shown) is included to supply electrical power to the actuation mechanism 14 sufficient to puncture and also to open the first container 16. Energy sufficient for these purposes can be stored in other forms as well (spring, chemical, etc.) and used when needed to power the actuation mechanism 14.

A manual-inflation pull cord 18 is provided to puncture the first container 16 and to release the compressed gas from the first container 16 so as to inflate the vest 12 on demand. This is useful if the actuation mechanism 14 should, for any reason, fail to operate properly or whenever the user 8 decides that he wants to inflate the vest 12.

A tube 20 is also provided for manual inflation and to add air to the vest 12 should some of the gas therein happen to leak out. Additional tubes (not shown), one for each of the compartments 12*a*–12*c* may be included, if desired.

The first container 16 is attached to the visible floatation device 10, where desired. It may be disposed in the first compartment 12*a* or elsewhere. The actuation mechanism 14 must either be attached to the first container 16 or otherwise connected thereto.

A device (not shown) to either puncture the first container 16 or to otherwise effect release of the gas therein must also be included and is considered to be a part of the actuation mechanism 14, regardless of where the first container 16 or the actuation mechanism 14 may be located.

A lighter than air balloon 22 is included with the visible floatation device 10 and is preferably deployed simultaneously whenever the vest 12 is inflated.

Accordingly, the actuation mechanism 14 is also used to inflate and to deploy the balloon 22 when the vest 12 is inflated. Deployment of the balloon 22 includes filling it with a lighter-than-air gas sufficient to permit it to rise in the air.

A tether 24 secures the balloon 22 to the visible floatation device 10. The tether 24 is attached to the visible floatation device 10 where desired. The tether 24 is of any preferred material and is of any desired length. An optimum length for the tether 24 would be approximately thirty feet long. This would raise the balloon 22 to a height that is likely to exceed that of any waves.

If the first container 16 contains a lighter-than-air type of a gas, it may also be used to inflate the balloon 24. Preferably, upon the balloon 24 being sufficiently inflated but not over-inflated, it releases automatically from the vest 12 portion of the visible floatation device 10 and rises naturally to provide a highly visible object that is suspended in the air disposed generally above the user 8. Devices to facilitate such release are known and are discussed in certain of the cited prior art patents. These and other similar types of "release mechanisms" may be incorporated into the visible floatation device 10, as desired.

The balloon 22 may also be manually separated apart from the vest 12 portion of the visible floatation device 10. If desired a second container 28 may be used and filled with a lighter-than-air gas and be used to fill the balloon 22. A more basic version of the visible floatation device 10 may include a second manual pull cord 26 to release the lighter-than-air gas that is contained in the second container 28 and fill the balloon 22. Obviously, a one-way valve (not shown) or similar device must be included in the construction of the balloon 22 so as to maintain the gas therein once it is filled.

Clearly, many options and design configurations are possible providing the visible floatation device 10 includes the balloon 22 that is filled with a gas that is lighter-than-air so that the balloon 22 is able to float in the air above the user 8 while being tethered to the visible floatation device 10. This will make spotting the user 8 easy while also providing the necessary buoyancy.

The balloon 22 may be any size and shape, as preferred. It is preferred that the balloon 22 not only be highly visible to a spotter (not shown) but also to radar.

Figure 2:
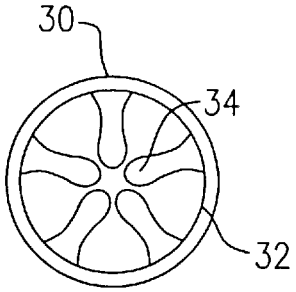
FIG. 2 is a cross sectional view taken on the line 2—2 in FIG. 1.

Referring now also to FIG. 2, a cross sectional view of the balloon 22 reveals an outer layer 30 (i.e. outer lining) that is preferably brightly colored. An inner layer 32 (i.e. inner lining) is formed of any strong yet radar reflective material. MYLAR film is one material that could be used to form the inner layer 32. If the outer layer 30 is colorful yet transparent to radar and the inner layer 32 is highly reflective of radar then the balloon 22 is optimally visible both to the spotter and to radar.

If desired, the outer layer 30 may be painted on top of the inner layer 32. The inner layer 32 must, of course, be able to retain the gas therein.

The balloon 22 may be round or oval in shape and dimples 34, 36 or other surface irregularities may be used to increase radar reflectivity. The dimples 34, 36 and surface irregularity are intended to aid in reflecting radar energy back to the source thereby creating a stronger signal return and better radar visibility.

In the deflated state, the balloon 22 is attached to the vest 12 where desired. It may be visible on an external surface of the vest 12 or it may be disposed in its own compartment that ruptures easily when the balloon 22 is inflated.

The garment portion may be other than the vest 12, as shown. It may also include a substance or material, for example foam or Styrofoam, that is naturally buoyant. The buoyant material may be used as a fail-safe backup in case the compartments 12*a*–12*c* leak.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A visible floatation device, comprising:

(a) means for providing a garment;

(b) means for providing a lighter than air balloon, said balloon including an inner radar-reflective liner disposed within an outer liner; and (c) means for providing a tether intermediate said balloon and said garment.

2. The visible floatation device of claim 1 wherein said garment includes buoyancy means.

3. The visible floatation device of claim 2 wherein said buoyancy means includes an inflatable vest.

4. The visible floatation device of claim 1 including means for actuating said inflatable vest.

5. The visible floatation device of claim 1 including means for actuating said lighter than air balloon.

6. A visible floatation device adapted to be worn by a person, comprising:

(a) floatation means;

(b) means for providing a lighter than air balloon, said balloon including an inner radar-reflective liner disposed within an outer liner; and (c) means for providing a tether intermediate said balloon and said floatation means.

7. The visible floatation device of claim 6 including actuation means for inflating said floatation means and said balloon.

8. The visible floatation device of claim 7 wherein said actuation means is adapted to inflate said floatation means and said balloon subsequent to said actuation means being immersed in water.

9. The visible floatation device of claim 8 wherein said actuation means is adapted to inflate said floatation means and said balloon subsequent to said actuation means being disposed a predetermined depth below the surface of the water.

10. The visible floatation device of claim 6 wherein said balloon includes surface irregularities.

11. The visible floatation device of claim 6 wherein said floatation means includes manual means for inflating said floatation means.

12. The visible floatation device of claim 6 wherein said lighter than air balloon includes means for inflating said balloon with a gas that is lighter than air.

13. The visible floatation device of claim 12 wherein said means for inflating includes automatic means.

14. The visible floatation device of claim 12 wherein said means for inflating includes manual means.

15. The visible floatation device of claim 6 wherein said lighter than air balloon includes means for releasing said balloon from said vest.

16. The visible floatation device of claim 15 wherein said means for releasing is adapted to release said balloon after said balloon has been inflated.

* * * * *